US005111862A

United States Patent [19]

Dietz

[11] Patent Number: 5,111,862

[45] Date of Patent: May 12, 1992

[54] METHOD FOR FLATTENING LOGS

[75] Inventor: Hans Dietz, Ammerbuch, Fed. Rep. of Germany

[73] Assignee: Wurster u. Dietz GmbH u. Co. Maschinenfabrik, Tubingen-Derendingen, Fed. Rep. of Germany

[21] Appl. No.: 649,040

[22] Filed: Feb. 1, 1991

[30] Foreign Application Priority Data

Feb. 2, 1990 [DE] Fed. Rep. of Germany ..... 4003023

[51] Int. Cl.[5] ..... B27B 1/00

[52] U.S. Cl. ..... 144/357; 83/367; 144/377; 144/378; 364/474.09

[58] Field of Search ..... 83/33, 36, 365, 367, 83/371; 144/356, 357, 376, 377, 378; 364/474.09, 474.34

[56] References Cited

U.S. PATENT DOCUMENTS

| | | | |
|---|---|---|---|
| 4,441,537 | 4/1984 | Vartiainen | 144/378 |
| 4,688,614 | 8/1987 | Jenker | 144/378 |
| 4,774,988 | 10/1988 | Washburn et al. | 144/357 |
| 4,839,816 | 6/1989 | Cattrall et al. | 83/367 |

FOREIGN PATENT DOCUMENTS

| | | |
|---|---|---|
| 3244393 | 12/1982 | Fed. Rep. of Germany . |
| 3730865 | 9/1987 | Fed. Rep. of Germany . |

*Primary Examiner*—W. Donald Bray
*Attorney, Agent, or Firm*—Kokjer, Kircher, Bowman & Johnson

[57] ABSTRACT

A method serves for flattening logs (10) showing a curved longitudinal center line (10*a*). The logs (10) are conveyed in horizontal position in their longitudinal direction, with their convex side (11) up and their concave side (12) down. The concave side (11) of the logs (10) is flattened from below in the area of their butt ends (27). In order to optimize the yield in wood, the logs (10) are measured before carrying out the flattening step, in a position where they are supported on a reference plane (13) by the end points (20, 22) of their concave side (12) only. The geometrical position of a first point (26) of the log (10) is determined on the convex side (11) as its elevation above the reference plane (13). The butt end (27) of the log (10) is then lowered, while keeping the end point (20) opposite the butt end of the log constantly in contact with the reference plane (13), until the first point, which defines the lowest point between the said highest elevation (23) and the said butt end (27) on the said convex side (11), comes to lie at a level above the reference plane (13) which corresponds to the diameter ($d_0$) of the said log (10) at its end opposite the said butt end. Thereafter, the logs (10) are flattened in this lowered position up to the reference plane (13) (FIG. 1).

1 Claim, 3 Drawing Sheets

METHOD FOR FLATTENING LOGS

The present invention relates to a method for flattening logs showing a curved longitudinal center line comprising the steps of conveying the logs in horizontal position in their longitudinal direction, with their convex side up and their concave side down, flattening the concave side of the logs from below in the area of their butt ends, measuring the logs before the flattening step in a position where they are supported on a reference plane by the end points of their concave side only, with the geometrical position of a first point of the log being determined as its elevation above the reference plane, and lowering the butt end of the log thereafter, while keeping the end point opposite the butt end of the log constantly in contact with the reference plane, until the first point comes to lie in a predetermined plane, and finally flattening the logs in this lowered position up to the reference plane.

A method and a device of the kind described above have been known from DE-OS 37 30 865.

It is a generally known fact that logs arriving at timber mills for being worked into square timber or boards or the like, have a strictly straight natural shape only in very rare cases. In practice, the arriving logs normally show a curved longitudinal center line so that this curved natural shape has to be taken into consideration when working the logs if the desired optimum yield in wood is to be attained. In addition, the particular shape of the so-called butt end, i.e. the thicker log portion at the transition to the root area, constitutes another potential source of errors. For reasons of optimum yield, trunks are normally cut as close as possible to the ground so that a considerable part of the log length, for example one meter, has a progressively enlarging shape and, consequently, a considerably larger cross-section than the remaining part of the log whose diameter normally decreases more or less regularly. Now, when the butt end of such a log comes to rest on a level surface of a conveyor system of the type usually employed in timber mills, then the log would occupy a very oblique position, even in the case of an otherwise straight longitudinal center line, due to the fact that the thicker log end would be raised as a result of the considerably larger diameter of the butt end.

When a log has a curved natural shape and in addition a very thick butt end, these two circumstances may possibly add up making it difficult to present the log for processing in a position in which the best possible yield in wood can be achieved.

DE-PS 32 44 393 has proposed in this connection to flatten the log in the surface area which exhibits a concave shape in the longitudinal direction of the log, at least in part at the butt end and along a plane which extends substantially in parallel to a plane being tangent to the two log ends in the other surface area, i.e. the one that exhibits a convex shape in the longitudinal direction of the log.

In the case of the known method and the known device, therefore, the butt end is flattened unilaterally on the concave side of the log so that the latter comes to rest on the conveyor in a flatter position whereby an improved yield is achieved.

However, it has been found in practice that the before-described method, and the related device, do not lead to the best possible yield in wood, especially in the case of heavily curved logs, so that there is still a need for further improvement of the location and preparation of the logs in order to ensure the best possible yield in wood even for very heavily curved logs.

In the case of the before-described method known from DE-OS 37 30 865, the logs are measured before the flattening operation in such a way that the location of the first point is determined on the concave side as the point of maximum flexion, measured by its distance from the butt-side end point and its elevation above the reference plane. One then lowers the log at its butt end until the first point comes to lie in the reference plane.

Although the known method can be employed with advantage in many cases, there are still cases where improved results are desired for particular species of trees, or specific typical natural shapes.

Now, it is the object of the present invention to improve a method and a device of the before-mentioned type in such a way as to account for these objectives.

Based on the method described above, the invention solves this object by the fact that the first point defines the lowest point between the highest elevation and the butt end on the convex side and that the predetermined plane extends above the reference plane at a level corresponding to the diameter of the log at its end opposite the butt end.

This solves the object underlying the invention fully and completely because the before-described measures permit an even higher yield in wood, as compared to the described known method, to be achieved from a plurality of species of trees or from certain kinds of natural shapes. In addition, the method according to the invention provides the advantage that it is easier to carry out in practice because only two diameters have to be determined.

Other advantages of the invention will appear from the specification and the attached drawing.

It is understood that the features that have been described before and will be explained hereafter may be used not only in the described combinations, but also in any other combination, or individually, without leaving the scope and intent of the present invention.

Certain embodiments of the invention will now be described in more detail with reference to the drawing in which: dr FIG. 1 shows a side view of a log having a curved natural shape and a pronounced butt end, as well as the measuring points of interest for the purposes of the present invention, and their coordinates;

Figure 1:
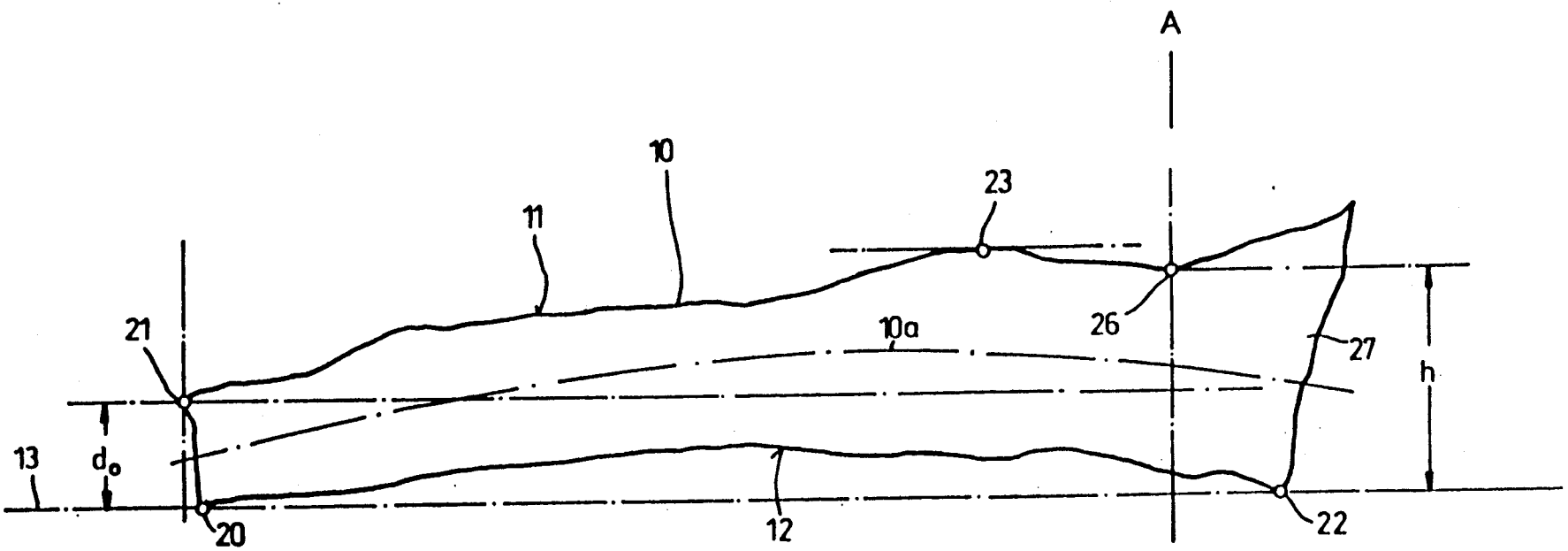

In FIG. 1, a log of natural shape having a curved longitudinal center axis 10*a* is indicated generally by 10.

The log 10 is represented in lying position, with a convex curved side 11 pointing upwardly and a concave curved side pointing in downward direction. The log 10 rests in this position on a reference plane indicated by 13, for example an upper plane of a conveyor system of a timber mill.

At the left—as viewed in FIG. 1—thinner end of the log 10, the end points of the thinner end are defined by a first point 20 and a second point 21, and the diameter of the log 10 at the thinner end is indicated by $d_0$. Regarding now the opposite, thicker end of the log, the log 10 rests on the reference plane 13 by a third point 22. A fourth point 23 defines the point of highest elevation on the convex side 11 of the log 10. A fifth point 26 defines the lowest point between the fourth point 23 of highest elevation and the butt end 27, on the convex side 11. The height of the log 10 at the fifth point 26 is identified as h.

The values of $d_0$ and h can be determined with the aid of conventional measuring systems, as will be described in more detail further below, with reference to FIGS. 3 to 5.

Figure 2:
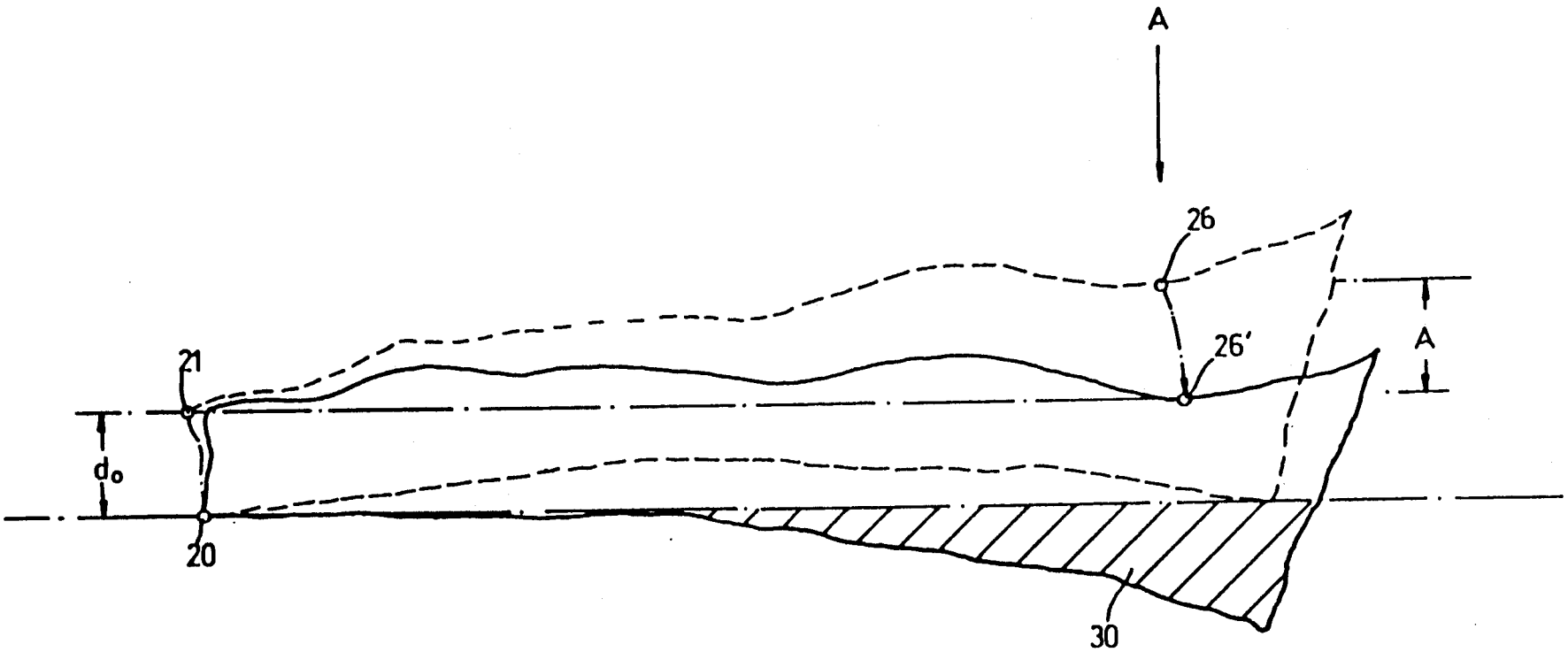
FIG. 2 shows the log illustrated in FIG. 1, but with one end lowered relative to a reference plane, as proposed by the invention.

In order to prepare a log 10 in a manner such that the subsequent processing operations can be carried out with the best possible yield in wood, the log 10 should be lowered to a position—as illustrated in detail in FIG. 2—where the first point 20 at the thinner end of the log 10 remains on the reference plane 13 while the butt end 27 at the thicker end of the log 10 is lowered until the fifth point 26 on the convex side 11 comes to lie at the same level above the reference plane 13 as the second point 21.

For this purpose, one derives from the before-mentioned measured values $d_0$ and h a lowering value A which can be identified by the formula:

$$A = h - d_0.$$

One then lowers the log 10 by the lowering value A substantially in the radial plane which is marked by the fifth point 26, i.e. approximately in the area of the transition between the butt end 27 and the remaining log 10.

As can be seen best in FIG. 2, this lowering movement brings the log 10 from an initial position indicated by dashed lines, and corresponding to the position illustrated in FIG. 1, to its final position illustrated by full lines. The seventh point 26 becomes 26' and comes to lie at the level $d_0$ above the reference plane 13.

Resting in this lowered position, the log 10 is now flattened from below up to the reference plane 13 which means that the shaded portion 30 in FIG. 2 is removed by chipping or cutting.

Flattened in this manner, the log now has an optimum contour in the horizontal direction for the subsequent working operations, under the aspect of maximum space utilization. The following working operations may then, in the known manner, consist in flattening also the other three sides of the log 10 and cutting thereafter boards or square timber from the flattened sides.

Figure 3:
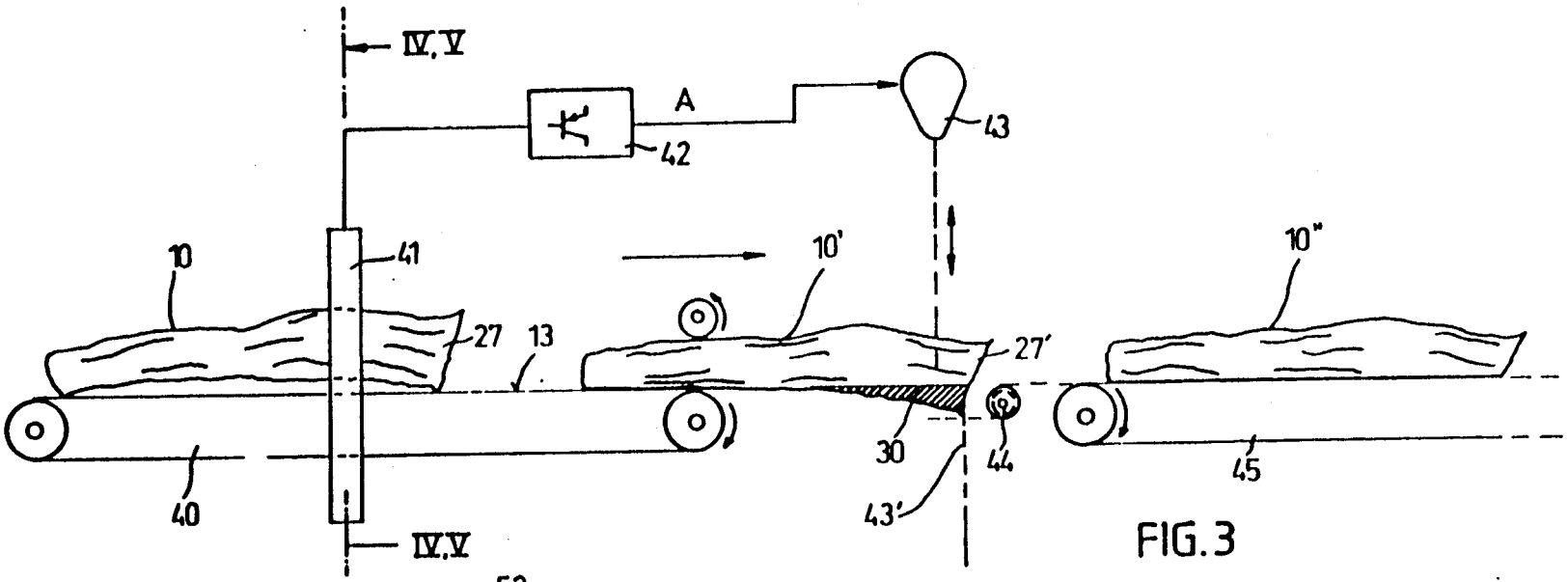
FIG. 3 shows a very diagrammatic side view of a device intended for carrying out the method according to the invention.

In FIG. 3 which illustrates an embodiment of a known device that may be used also for carrying out the method described before with reference to FIGS. 1 and 2, reference numeral 40 indicates a first feeding system, for example a conveyor belt, by which the log 10 is conveyed from the left to the right, as viewed in FIG. 3. In the illustrated case, the log is conveyed with its butt end 27 in forward position, but this is not necessarily so because the elements that will be described hereafter can be adapted without any difficulty to enable the log 10 to be conveyed with its thin end in forward position.

On its way along the first conveyor system 40, the log 10 passes through a light curtain 41 of the type that will be described in more detail further below, by reference to FIGS. 4 and 5. The light curtain 41 is connected to a control unit 42 so that all characteristic values $d_0$, $d_1$, and $d_{max}$ that have been described above in connection with FIG. 1 are supplied to the control unit 42. The control unit 42 derives from these input values the lowering value A which is then used by it for controlling a lifting device 43 to grip the log 10 in the area of its butt end. It can be clearly seen in FIG. 3 that after the log 10' has left the first conveyor system 40, its butt end 27 is left to project freely so that the butt end 27' can be lowered by the lowering value A while the thin end of the log 10' remains continuously supported. The lowering movement brings the area 30 below the reference plane 13 where it can be removed by means of a milling cutter 44 or some other suitable tool. It is understood that instead of using an overhead lifting system 34, as shown in FIG. 3, it is of course also possible to make use of a lifting device 43' acting from below, for lowering the butt end 27' in the described way.

The flattened log 10'' is then taken over by a second conveyor system 45 transporting it in the conventional manner to other working stations, such as additional flattening stations, corner-milling stations, cutting-out or cross-cutting saws, or the like.

Figure 5:
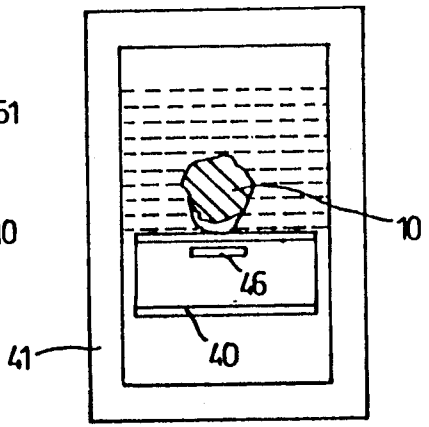
FIGS. 4 and 5 show views in the direction of the plane IV—V—IV—V in FIG. 3, for two different conveying positions of logs.
Figure 4:
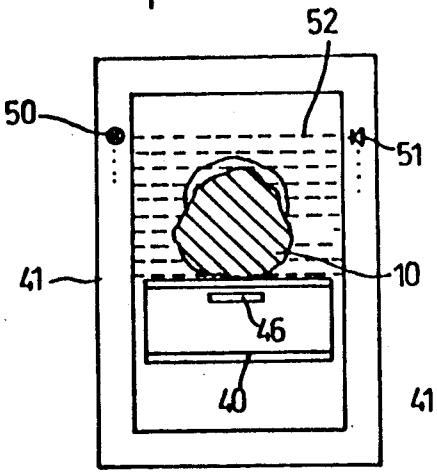

FIGS. 4 and 5 show two different positions of the log 10 passing the light curtain 41. It can be seen that the light curtain 41 consists, preferably, of a rectangular frame surrounding the first conveyor system 40 by all sides. Light transmitters 50 arranged in one vertical frame part coact with light receivers 51, for example photo diodes or the like, arranged oppositely on the other vertical frame part. This arrangement produces to a curtain of light rays 52, i.e. a plurality of horizontal light barriers arranged one above the other, which are interrupted by the contour of the log to a greater or lesser degree. FIG. 5 shows clearly that this arrangement enables the contour of the log 10 to be detected in a no-contact manner even in the area of the convex side 12.

In discussing the device according to FIGS. 3 and 5 it should further be noted that although the lifting means 43 and/or 43' may act upon the log at the fifth point 26 in the lowering plane indicated by A in FIGS. 1 and 2, this is not necessarily so, it being of course also possible to lower the log in the radial plane defined by the third point 22, or in some other radial plane provided that in this case the stated formula for the lowering value A would have to be adapted accordingly.

I claim:

1. A method for flattening logs, said logs having a first end of a first, smaller diameter and a second, enlarged end of a second, larger diameter, said logs having, further, one convex lateral side and one opposite, concave side with a curved longitudinal center line there between, the method comprising the steps of:

positioning said log, in a first position, horizontally on a reference support plane with said concave side down and said convex side up, said first end resting on said plane in a first point and said second end resting on said plane in a second point;

determining a third point on said convex side, said third point having highest elevation of all points of said convex side above said plane;

determining a fourth point on said convex side, said fourth point having lowest elevation of all points of said convex side between said third point and said second end;

lowering said second point on said second end of said log below said plane, while said first point on said first end remains on said plane, and monitoring the elevation of said fourth point above said plane during said step of lowering until, in a second position, said fourth point has an elevation above said plane being equal to said first diameter;

gripping said log in said second position; and flattening said log by machining-off said log from below up to said plane.

* * * * *